US006136436A

United States Patent [19]

Kennedy et al.

[11] Patent Number: 6,136,436

[45] Date of Patent: Oct. 24, 2000

[54] SOFT SILKY LARGE DENIER BICOMPONENT SYNTHETIC FILAMENT

[75] Inventors: James R. Kennedy, Smyrna; Edward J. Negola, Roswell, both of Ga.

[73] Assignee: Nyltec Inc., Smyrna, Ga.

[21] Appl. No.: 08/911,193

[22] Filed: Aug. 14, 1997

Related U.S. Application Data

[63] Continuation of application No. 08/702,124, Aug. 23, 1996, abandoned.

[51] Int. Cl.[7] ..... D02G 3/00; D01D 5/22

[52] U.S. Cl. ..... 428/373; 428/95; 428/374; 428/364; 428/395; 264/168; 264/210.1; 264/171

[58] Field of Search ..... 428/95, 373, 374, 428/364, 395, 394, 359; 264/168, 210.1, 171

[56] References Cited

U.S. PATENT DOCUMENTS

| | | | |
|---|---|---|---|
| 3,803,453 | 4/1974 | Hull | 428/373 |
| 3,895,151 | 7/1975 | Matthews et al. | 428/102 |
| 4,420,534 | 12/1983 | Matsui et al. | 428/373 |
| 4,457,973 | 7/1984 | Matsui et al. | 428/373 |
| 4,547,420 | 10/1985 | Krueger et al. | 428/373 |
| 4,711,812 | 12/1987 | Burns | 428/373 |
| 4,795,668 | 1/1989 | Krueger et al. | 428/373 |
| 5,202,185 | 4/1993 | Samuelson | 428/373 |
| 5,534,339 | 7/1996 | Stokes | 428/373 |
| 5,549,957 | 8/1996 | Negola et al. | 428/92 |

*Primary Examiner*—William Krynski
*Assistant Examiner*—J. M. Gray
*Attorney, Agent, or Firm*—Schweitzer Cornman Gross & Bondell LLP

[57] ABSTRACT

A method for producing a yarn for constructing non-carpet textile articles which comprises producing a large denier synthetic carpet face yarn by a bulked continuous filament or bulked crimped filament sheath-core extrusion process. The yarn has a denier of at least 300, and preferably around 1400, and is comprised of a plurality of filaments in the denier range of 10–20 denier per filament. Each filament has an outer sheath of nylon or polyester and an inner core of polyolefin, with the sheath comprising 20 to 60% of the total weight of each filament and the core constituting the remainder. The yarn, although very large by the standards applied to non-carpet textile articles, has a silky, soft feel similar to yarns composed of much smaller filaments of homopolymer nylon or polyester, and is thus well suited for the manufacture of non-carpet textile articles, such as upholstery fabrics, sweaters and the like.

4 Claims, No Drawings

SOFT SILKY LARGE DENIER BICOMPONENT SYNTHETIC FILAMENT

RELATED APPLICATIONS

This application is a continuation of our prior copending application Ser. No. 702,124, filed Aug. 23, 1996, now abandoned.

FIELD OF THE INVENTION

This invention relates generally to synthetic filaments manufactured using bicomponent or sheath core manufacturing methods. More particularly this invention relates to a yarn that is formed of many bicomponent filaments manufactured using course denier carpet yarn extrusion machinery. The resultant sheath core yarn is surprisingly soft and can be used to manufacture textile products that would not ordinarily use course denier carpet yarn. This invention discloses selecting the proper materials to make the filaments and how the filaments should be extruded, texturized and dyed.

BACKGROUND OF THE INVENTION

The present invention relates to continuous or staple bicomponent filaments or yarn used in knitted, tufted, flocked, woven or nonwoven quality textile products requiring a soft hand or soft feel.

Synthetic fibers are continuing to grow, in the field of textiles due to needs of expanding world population and the limited availability of natural fibers such as cotton and wool. Cotton, silk and wool use is growing but at a much slower rate due to the naturally occurring constraints that these fibers bring with them. Some of these constraints are the growing seasons, the available land for crops and animals, and the harvesting of these natural fibers. Consequently synthetic textile fibers are rapidly expanding to fill the ever growing needs of the marketplace.

One of the problems that face these textile manufacturers is the need for these synthetic fibers to be soft to the touch if the end use is for clothing or home furnishings. People want a soft feeling product. In order to make synthetic fibers feel soft the manufacturer must make the fibers into very small deniers similar to naturally occurring fibers. Some manufacturers are even producing micro fibers as taught by Park et. al. in U.S. Pat. No. 4,460,649 that are smaller than natural fibers.

The small denier size of the fibers puts additional constraints on the manufacturer because it takes more equipment and more time and consequently more money to produces these small fibers. It would be an economical advantage if the manufacturers could increase the denier of the filaments and still keep the soft desirable feel or hand. Presently no one has suggested a way to increase throughput by increasing the denier size and retain the soft feel of smaller denier filaments.

This invention teaches how to manufacture a large denier sheath core bicomponent synthetic filament that has the hand and soft feel of a small denier filament. Through the use of bicomponent sheath core technology the inventors produced an 18 denier bicomponent filament that has the same feel as a 5–6 denier homopolymer filament.

This large soft feeling bicomponent filament would be excellent for use in the manufacture of textile outerwear such as coats, jackets, and sweaters scarves etc. as well as an home furnishing, upholstery or knitting yarns. Anyone skilled in the art would vary the dnier size and sheath percentage to suit the end use for a soft yarn.

A yarn whether natural or synthetic, is composed of many filaments. Each filament is measured and assigned a denier size. Naturally occurring filaments such as silk or cotton usually occur within a given range of filament sizes. A cotton filament is usually 1.5 denier and silk is usually 1 denier. Wool ranges in size and is determined by the type of sheep that it comes from. Carpet wools are course and measure in the 15 to 20 denier range while softer wools are in the two to six denier range. A denier is a measurement well known to those skilled in the art. As previously stated Synthetic filaments are extruded and textured to mimic or mirror natural filaments. Recently, great strides have been made in manufacturing machinery that can extrude micro denier sizes of from 0.5 to 3 denier filaments. The machines are costly and do not produce massive quantities of filaments without a great deal of capital investment. The synthetic filaments produced are pleasing to the touch and are used alone or in blends to create yarns that are extremely soft and have a silky "hand" or feel.

Almost all of the micro denier synthetic filaments are produced by extruding molten polymer through tiny holes in spinnerets. The size of the hole combined with draw ratio determines the denier of the filament. The smaller the denier size that is extruded the softer the yarn comprising a bundle of these small denier filaments will be. A synthetic yarn comprising a bundle of 35 filaments of 1.5 denier each will feel like a natural cotton yarn to the touch. Various other factors such as spin finish and water absorption ability will also affect the feel or hand of the yarn. These yarns are classified as textile yarns as they are well suited to clothing and home furnishings fabrics and not carpets or industrial yarns.

A bundle of synthetic filaments are extruded as continuous filament yarn or as many ends of filaments called staple tow which is drawn, crimped cut into lengths similar to those naturally occurring in cotton. The cut staple is then spun into a yarn size to suit the end use that was intended by the textile manufacturer. Larger yarns such as a 8/1 cc cotton would be used in bath mats or course upholstery fabric while a 30/2 cc cotton would be used to make a textile fabric suitable for clothing.

Soft yarns are woven, tufted, flocked, needlebonded, calendered, or knitted into a textile cloth or fabric to satisfy the appropriate end use.

Lin Fa Lee U.S. Pat. No. 3,992,499 shows the possibility of extruding two filaments of differing dyeability using a sheath core system of feeding two molten polymers of differring dye affinity to a special spinneret. The patent teaches how to dye heather effects for apparel by varying the amount of polymer having differing dye receptors. The yarn sizes in each example are tiny deniers useful in the manufacture of textile products.

Ando et al. U.S. Pat. No. 3,551,279 uses sheath core bicomponent tiny filaments with varying amounts of titanium dioxide in either the sheath or the core or both to create a difference in luster's of light reflection when woven into a fine apparel or fabric.

Both of these patents teach using bicomponent technology to get a special effect in a textile yarn but do not teach or infer how to produce a soft feeling bicomponent textile yarn made from large denier sizes.

Present technology of machine engineering allows for a much smaller denier or apparent denier by separating a sheath and a core as is shown in Park et al. U.S. Pat. No. 4,460,649). This patent shows that a composite fiber consisting of two components such as a polyamide and a polyester wherein the two components can be separated into a plurality of microfibers by chemical and physical treatments. A 70 denier 20 filament yarn was separated to yield an apparent 5 denier per filament yarn which was suitable for a woven cloth possessing the attributes of artificial suede. Park is trying to make the fibers extremely small in order to get a desirable feel and other associated benefits not make a large denier yarn that feels soft.

Other techniques called "island in the sea" extrusions also produce mircro deniers. The equipment used to manufacture the filaments is expensive and the texturing process called false twist texturing is also very expensive.

SUMMARY OF THE INVENTION

The present invention relates to synthetic bicomponent filaments and multi filament yarns that have unique and surprising characteristics.

The principle bicomponent filaments disclosed herein utilize nylon as an outer sheath and polypropylene or olefin as the core. The core has a lower specific gravity and a dissimilar polymer make up. One skilled in the art could use PET or Polyester as the sheath. These filaments are textured by the bulked continuous filament method or by the crimping method when making staple tow. If polyester is used in the sheath steam in the heated yarn feed draw texturing process must be used and the polyester must be free of all moisture before extruding.

This invention produces a silky soft feeling large denier filament (from 6 dpf to 18 dpf) and is easy to mass produce using carpet yarn extrusion and carpet texturizing techniques.

There is a surprising relationship which determines the softness of the filament. Bicomponent sheath core filaments having a sheath of nylon and a core of polypropylene were extruded using sheath core extrusion spinneret well known in the art. The resultant multi filament yarn was soft and silky to the touch with a bright and shiny appearance.

The yarn feels like a denier equivalent to the total filament size multiplied by the percentage of nylon sheath applied. Thus an 18 denier per filament bicomponent fiber with a sheath of 30% nylon and a core of 70% polypropylene feels like a 5.4 to 6 denier nylon homopolymer filament. One skilled in the art would vary the sheath to core ratio to produce the desired effect for the required end use. A 40% sheath on a larger size denier per lilament would result in a soft yarn that is more suitable for commercial upholstery etc.

A preferred embodiment of the invention is to manufacture a silky soft yarn by extruding bicomponent filaments having a 30% nylon sheath and a 70% polypropylene core. The filaments are extruded and texturized by the BCF method on machines normally used to manufacture carpet yarns. These machines usually produce filaments in the 18–24 denier range. Using carpet extrusion processes to create soft feeling textile yarns greatly reduces the cost of producing silky soft yarns. These soft yarns can be used to make products that ordinarily require yarns made on more expensive small denier or micro denier machinery. This will be further elaborated by the examples set forth.

There are numerous advantages to using this invention to produce silky soft yarns.

1. Raw materials cost less than homopolymers,
2. Raw materials cost less than natural yarns,
3. Filaments are mass produced on less costly carpet extrusion machines,
4. Reduced dye costs and reduced chemical costs.

This novel invention teaches how to produce new silky soft economical bicomponent textile filaments.

DETAILED DESCRIPTION OF PARTICULAR EMBODIMENTS OF THE INVENTION

A process for producing a multi filament yarn composed of a plurality of filaments melt spun by the sheath core method using virgin nylon as the sheath and polypropylene as the core for use as a textile yarn. The filaments are processed for textile yarn using a bulking method called bulked continuous filament (BCF) or by a crimping method used in the manufacture of staple carpet fibers. A BCF yarn can be used directly from the extrusion process to manufacture apparel or fabrics or a bicomponent crimped filament staple tow must be further processed by spinning into a weaving, knitting or tufing yarn or using staple to create a non woven or needlebonded or flocked textile fabric.

EXAMPLE 1

A bulked continuous filament sheath-core carpet yarn was produced by melt spinning a 30% sheath of Nylon 6 with a Relative Viscosity of 2.7) and a 70% undyed core of polypropylene (melt index of 18) in a one-step process into a BCF carpet yarn. The melt spinning was done using a two extruder setup equipped with a spin beam and spin packs that mix the flow of polymers together to make a sheath-core filament. Each extruder has a similar polymer pump that regulates the flow of polymer through the system by the pump revolutions per minute and consequently determines the sheath-core mix. In order to make a 30/70 sheath to core ratio the core pump was set at 19.29 rpm and the sheath pump was set at 8.27 rpm. Adjusting the sheath-core process for different polymers and different percentage sheath to core combinations is accomplished by increasing or decreasing the extruder melt temperatures and changing the flow rates on the polymer pumps. Once both materials form as fiber the two streams are mixed together to achieve a desired percentage of sheath to core.

The extruder zone temperatures for the Nylon 6 were 260/265/270/275 degrees centigrade and the four extruder zone temperatures for the polypropylene were 201/240/250/260 degrees centigrade. The processing temperature for the Nylon 6 was 273 degrees centigrade and the processing temperature for the polypropylene was 274 degrees centigrade. The polymer pumps were set for a 30% sheath and a 70% core. Once the process is stabilized you examine the cross-section of the fibers under a microscope to ensure good sheathing around each filament. When a circular cross section was used, some slight variation in the size of the individual filaments resulted and a kidney bean shaped core rather than a completely circular core was observed under a microscope. When a trilobal shape was used, a delta cross section with a more uniform sheath was observed. The Nylon sheath and the polypropylene core do not bond together because nylon is a dissimilar material from polypropylene. Microscopic examination revealed that this difference (which was required in order to form the sheath/core relationship) caused voids to appear in the core between the outer sheath of nylon and the polypropylene core; and furthermore some voids or bubbles were caused entirely within the core itself. However, the sheathing was quite adequate and the voids or bubbles within the polypropylene core actually increased the bulkiness of the total yarn which is an unexpected and beneficial effect.

When a round cross section was used the overall effect produced a soft large denier bicomponent yarn that feels like a similar small denier 100% nylon homopolymer yarn. The resultant yarn was very soft to the touch and felt like a yarn composed of 5–6 denier nylon homopolymer filaments even though it was yarn composed of relatively large 18 denier nylon/pp bicomponent filaments. The yarn produced had 72 filaments of 18 denier per filament. One skilled in the art would vary the number of filaments and the type of take up to vary the size of the yarn from a total of 300 denier to 3000 denier depending on the end use.

EXAMPLE 2

A 1400 denier 72 filament yarn is prepared according to the process described in example 1. The yarn was twisted on a carpet twisting machine with 4.75 turns to the inch. The single ply of the sheath core multi filament yarn was woven on a simple box loom into a basket weave where the warp and the weft used the same yarn of the invention. The fabric produced had 8 picks to the inch and was plain in appearance. The fabric was dyed to a uniform solid shade using the nylon dye process. Only the 30% sheath of nylon was dyed and this saved considerable expense in dye stuff and chemicals. The soft feeling fabric produced is suitable as an upholstery, wall covering or outerwear apparel fabric. By using a smaller total bundle of yarn denier one skilled in the art would vary the total weight of the fabric produced.

EXAMPLE 3

A 1400 denier 72 filament yarn is prepared according to the process described in example 1. The yarn was twisted on a carpet twisting machine with 4.75 turns to the inch. The yarn was further plied on the carpet twisting and plying machine to equal a 1400 denier two ply soft yarn. The yarn was space dyed using the knit de knit method of nylon dying at atmospheric pressures. The yarn was knitted on a flat bed sweater knitting machine. The resultant fabric was made into a soft tweedy sweater. The sweater was soft and silky to the touch. One skilled in the art would be able to package dye the yarn or to dye the finished garment after knitting. A savings in dying and finishing is accomplished as only the sheath is dyed by the nylon dye process. If the yarn were prepared using a polyester sheath according to the invention. The sheath portion of the yarn could be package dyed at elevated temperatures using the polyester disperse dye method. The knitted fabric could be dyed using a sublistatic polyester print method well known in the art.

EXAMPLE 4

A sheath core staple tow of 25,000 total denier of 13 denier per filament is prepared using a carpet staple extrusion machine. A sheath of 30% nylon covering a core of 70% olefin is a preferred embodiment. The tow is drawn and crimped heat set and cut into 2.5 inch staple lengths. The staple is carded and drawn into a sliver then twisted or spun into a cotton count of 10/1. The yarn is woven on a box loom using a basket weave having the same yarn in the warp and the weft. The fabric produced is soft and is dyed to a solid shade using the nylon dye method at atmospheric temperature. Only the 30% sheath of nylon was dyed and this saved considerable expense in dye stuff and chemicals. The soft feeling fabric produced is suitable as an upholstery, wall covering or outerwear apparel fabric. By using a smaller total bundle of staple tow and denier one skilled in the art would vary the total weight of the fabric produced. One skilled in the art would print the fabric with pleasing designs by using the nylon print method at atmospheric pressures.

If the yarn were prepared using a polyester sheath according to the invention, the sheath portion of the yarn could be package dyed at elevated temperatures using the polyester disperse dye method. The woven fabric could be dyed using a sublistatic polyester print method or heat transfer method well known in the art.

A sheath core staple tow of 25,000 total denier of 18 denier per filament is prepared using a carpet staple extrusion machine. A sheath of 30% nylon covering a core of 70% olefin is a preferred embodiment. The tow is drawn and crimped heat set and prepared as a rope to be cut into fibers suitable for flocking. A flocked fabric is prepared using the flocked filaments of the invention. The soft flocked fabric reproduced is printed using the nylon screen print method at atmospheric temperatures. The fabric thus produced is suitable as a wall covering or upholstery fabric. If the yarn were prepared using a polyester sheath according to the invention, the sheath portion of the yarn could be dyed at elevated temperatures using the polyester disperse dye method. The flocked fabric could be dyed using a sublistatic polyester print method or heat transfer print method well known in the art.

EXAMPLE 5

A sheath core staple tow of 25,000 total denier of 18 denier per filament is prepared using a carpet staple extrusion machine. A sheath of 30% nylon covering a core of 70% olefin is a preferred embodiment. The tow is drawn and crimped heat set and cut into 2.5 inch staple lengths. The staple is carded and drawn into a batting suitable for needle bonding a fabric. The fabric is prepared by the needlebonded of felt method of manufacture known to those skilled in the art. The felted soft fabric is dyed to a solid shade of pale beige dried and screen printed by the nylon dye method at atmospheric pressure. The resultant fabric is suitable for a wall covering and other pleasing home furnishing or decorative uses.

EXAMPLE 6

A 1400 denier 72 filament yarn is prepared according to the carpet yarn extrusion process described in example 1. The sheath core yarn was taken up on two positions of 700 denier each then textured by the BCF method. The single ply of the sheath core multi filament yarn was tufted on a narrow 5/64 gauge tufting machine 54 inches in width. The cut pile fabric was dyed to a uniform solid shade using the nylon dye process. Only the 30% sheath of nylon was dyed and this saved considerable expense in dye stuff and chemicals. The soft feeling fabric produced is suitable as an upholstery, wall covering or other decorative fabric. By using a smaller total bundle of yarn denier one skilled in the art would vary the total weight of the fabric produced. The fabric thus tufted and dyed could also be printed by the nylon dye process to create a fabric that is economical and pleasing.

What is claimed is:

1. A method of producing a yarn for constructing non-carpet textile articles which comprises (a) producing a large denier synthetic carpet face yarn by a bulked continuous filament sheath-core extrusion process, (b) said yarn having a denier of at least 300 and being comprised of a plurality of filaments in the denier range of 10–20 denier per filament, textured using a carpet BCF process, and wherein each filament in said yarn has (i) an outer sheath of nylon or polyester, (ii) an inner core consisting essentially of fiber-forming polypropylene or olefin, (iii) a sheath comprising from 20% to 60% of the total weight of each filament and a core constituting the remainder, and wherein (c) said yarn has a silky, soft feel similar to yarns composed of 2.5 to 10 denier per filament of homopolymer nylon or polyester filaments.

2. A non-carpet textile article woven or knitted primarily with a yarn according to claim 1.

3. A method of producing a yarn for constructing non-carpet textile articles which comprises (a) producing a large denier synthetic carpet face yarn using a bulked crimped filament sheath-core extrusion process, (b) said yarn having a denier of at least 300 and being comprised of a plurality of filaments in the denier range of 10–20 denier per filament, textured using a crimped staple carpet process, and wherein each filament in said yarn has (i) an outer sheath of nylon or polyester, (ii) an inner core consisting essentially of fiber-forming polypropylene or olefin, (iii) a sheath comprising from 20% to 60% of the total weight of each filament and a core constituting the remainder, and wherein (c) said yarn has a silky, soft feel similar to yarns composed of 2.5 to 10 denier per filament of homopolymer nylon or polyester filaments.

4. A non-carpet textile article woven or knitted primarily with a yarn according to claim 1.

* * * * *